US011142967B2

(12) United States Patent
De Waal et al.

(10) Patent No.: US 11,142,967 B2
(45) Date of Patent: Oct. 12, 2021

(54) WRENCH FOR BREAKING INTERNAL CONNECTIONS

(71) Applicant: Tercel Oilfield Products USA, LLC., Houston, TX (US)

(72) Inventors: Simon De Waal, Alberta (CA); Danilo S. Relos, Alberta (CA)

( * ) Notice: Subject to any disclaimer, the term of this patent is extended or adjusted under 35 U.S.C. 154(b) by 419 days.

(21) Appl. No.: 15/337,411

(22) Filed: Oct. 28, 2016

(65) Prior Publication Data

US 2017/0122045 A1 May 4, 2017

(30) Foreign Application Priority Data

Nov. 3, 2015 (CA) ..... CA 2911012
Jul. 15, 2016 (CA) ..... CA 2936248

(51) Int. Cl.
*E21B 19/16* (2006.01)
*E21B 4/00* (2006.01)

(52) U.S. Cl.
CPC ..... *E21B 19/163* (2013.01); *E21B 4/00* (2013.01)

(58) Field of Classification Search
CPC ..... E21B 19/163; B25B 13/12; B25B 13/20; B25B 13/16; B25B 13/44; B25B 13/5058; B25B 13/5016; B25B 13/5033; B25B 13/5041; B25B 13/505
USPC ..... 81/57.33
See application file for complete search history.

(56) References Cited

U.S. PATENT DOCUMENTS 2,696,747 A * 12/1954 Bergan ..... H01R 43/042 72/409.12
3,844,547 A 10/1974 Lang et al.
3,985,189 A * 10/1976 Jahnke ..... E21B 19/146 175/52
4,488,461 A * 12/1984 Hurtig ..... B25B 13/12 81/109

(Continued)

FOREIGN PATENT DOCUMENTS

GB 688328 A * 3/1953 ..... B25B 13/18

OTHER PUBLICATIONS

Fix-It Club "Wrench" Mar. 21, 2007. HowStuffWorks.com. <https://home.howstuffworks.com/wrench.htm> Aug. 15, 2019 (Year: 2007).*

(Continued)

*Primary Examiner* — Orlando E Aviles
*Assistant Examiner* — Joel D Crandall
(74) *Attorney, Agent, or Firm* — Pillsbury Winthrop Shaw Pittman LLP

(57) ABSTRACT

There is provided a wrench for a workpiece having a wrench head with a fixed jaw element and an adjustable jaw element opposite the fixed jaw element, the fixed jaw element and the adjustable jaw element defining a workpiece engagement area that receives and engages the workpiece. The fixed jaw element and the adjustable jaw element are connected by a pin and slot connection that permits movement of the adjustable jaw element relative to the fixed jaw element to adjust the size of the workpiece engagement area. A removable die is provided that engages the slot to restrict the movement of the pin along the slot and define a maximum size of the workpiece engagement area. An articulated actuator actuates the wrench head to apply torque to the workpiece.

11 Claims, 12 Drawing Sheets

(56) References Cited

U.S. PATENT DOCUMENTS

| | | | | |
|---|---|---|---|---|
| 4,593,585 | A * | 6/1986 | Hurtig | B25B 13/14 81/109 |
| 4,723,348 | A * | 2/1988 | Jaminet | B23P 19/06 29/240 |
| 5,060,542 | A | 10/1991 | Hauk | |
| 2003/0172781 | A1* | 9/2003 | Saunders | B25B 7/02 81/119 |
| 2012/0000319 | A1* | 1/2012 | Armstrong | B25B 13/04 81/13 |
| 2015/0082598 | A1 | 3/2015 | LaValley et al. | |

OTHER PUBLICATIONS

International Preliminary Report on Patentability and the Written Opinion of the International Searching Authority as issued in International Patent Application No. PCT/US2016/060142, dated May 8, 2018.

International Search Report from PCT application No. PCT/US2016/060142, dated Mar. 10, 2017, 12 pgs.

* cited by examiner

WRENCH FOR BREAKING INTERNAL CONNECTIONS

CROSS REFERENCE TO RELATED APPLICATIONS

This application claims the benefit of and priority to Canadian Patent Application No. 2,936,248, entitled "WRENCH FOR BREAKING INTERNAL CONNECTIONS," filed on Jul. 15, 2016, which claims the benefit of and priority to Canadian Patent Application No. 2,911,012, entitled "WRENCH FOR BREAKING INTERNAL CONNECTIONS," filed on Nov. 3, 2015, both of which are hereby incorporated by reference in their entireties for all purposes.

BACKGROUND

This relates to a wrench that is used to make up or break internal connections on a downhole motor.

Wrenches are generally used in industrial applications to apply torque to equipment, either to make up or release threads. For example, when servicing a downhole motor, a makeup/breakout tool is used to separate the various components, which are generally assembled by threaded connections. However, a wrench is generally used for smaller connections or equipment that cannot be engaged by a typical makeup/breakout tool. U.S. Pat. No. 3,844,547 teaches a wrench that can be used as a supplementary wrench for a larger breakout wrench. Gearench Manufacturing Co. of Clifton, Tex. (www.gearench.com) manufactures and sells a variety of wrenches for use in various circumstances.

BRIEF DESCRIPTION

Certain embodiments commensurate in scope with the original claims are summarized below. These embodiments are not intended to limit the scope of the claims, but rather these embodiments are intended only to provide a brief summary of possible forms of the claimed subject matter. Indeed, the claims may encompass a variety of forms that may be similar to or different from the embodiments set forth below.

According to an aspect, there is provided a wrench for a workpiece, comprising a wrench head, comprising a fixed jaw element and an adjustable jaw element opposite the fixed jaw element, the fixed jaw element and the adjustable jaw element defining a workpiece engagement area that receives and engages the workpiece, a pin and slot connection connecting the fixed jaw element and the adjustable jaw element that permits movement of the adjustable jaw element relative to the fixed jaw element to adjust the size of the workpiece engagement area, and a removable die that engages the slot to restrict the movement of the pin along the slot and define a maximum size of the workpiece engagement area, and an articulated actuator that actuates the wrench head to apply torque to the workpiece.

According to another aspect, the articulated actuator may comprise a telescopic actuator.

According to another aspect, the articulated actuator may comprise a first pivotal connection between the wrench and an elongate body and a second pivotal connection between the elongate body and a base.

According to another aspect, the elongate body may be a linear actuator.

According to another aspect, the wrench head may be reversible.

According to another aspect, the wrench may comprise a plurality of removable dies of different sizes corresponding to different workpiece engagement areas, each of the plurality of removable dies being interchangeable with another of the plurality of removable dies.

According to another aspect, the removable die may comprise a slot engagement portion that is received within the slot and an attachment portion that engages an attachment point on the wrench head.

According to another aspect, the attachment portion may be vertically offset from the engagement portion.

According to another aspect, the wrench may comprise two removable dies that engage opposite sides of the slot to restrict the movement of the pin.

According to an aspect, there is provided a method of using a wrench on a workpiece having a diameter, the method comprising the steps of providing a wrench head mounted to an articulated actuator, the wrench head comprising a fixed jaw element and an adjustable jaw element opposite the fixed jaw element, the fixed jaw element and the adjustable jaw element being connected by a pin and slot connection that permits movement of the adjustable jaw element relative to the fixed jaw element, the fixed jaw element and the adjustable jaw element defining a workpiece engagement area, defining a maximum size of the workpiece engagement area by engaging the slot with a removable die to restrict the movement of the pin along the slot, the maximum size being selected to accommodate the diameter of the workpiece, positioning the workpiece within the workpiece engagement area by moving the adjustable jaw element relative to the fixed jaw element, and with the workpiece within the workpiece engagement area, actuating the articulated actuator to cause the wrench head to apply torque to the workpiece.

According to another aspect, the articulated actuator may comprise a telescopic actuator.

According to another aspect, the articulated actuator may comprise a first pivotal connection between the wrench and an elongate body and a second pivotal connection between the elongate body and a base.

According to another aspect, the elongate body may be a linear actuator.

According to another aspect, the method may further comprise the step of reversing the wrench head relative to the workpiece to apply torque in an opposite direction.

According to another aspect, the method may further comprise the step of changing the maximum size of the workpiece by interchanging the removable die with another removable die selected from a plurality of removable dies of different sizes corresponding to different workpiece engagement areas According to another aspect, engaging the slot with a removable die may comprise inserting a slot engagement portion of the removable die within the slot and engaging an attachment point on the wrench head with an attachment portion of the removable die.

According to another aspect, the attachment portion may be vertically offset from the engagement portion.

According to another aspect, engaging the slot with a removable die may comprise engaging the slot with two removable dies that engage opposite sides of the slot to restrict the movement of the pin along the slot.

According to an aspect, there is provided a makeup/breakout tool, comprising a chassis, first and second workpiece clamps mounted to the chassis, wherein at least the first workpiece clamp is movable along a length of the chassis, each of the first and second workpiece clamps has a workpiece engagement area sized to receive a workpiece, the workpiece engagement areas being axially aligned, and at least one of the first and second workpiece clamps comprises a clamp actuator for applying torque to the workpiece, a wrench having a wrench head, the wrench being pivotally mounted to the first workpiece clamp, the wrench having a range of pivotal movement that allows the wrench head to move into and out of axial alignment with the workpiece engagement areas of the first and second workpiece clamps, and a wrench actuator that actuates the wrench head to apply torque to the workpiece.

According to another aspect, the wrench may be mounted to the first workpiece clamp by the wrench actuator, and the wrench actuator comprises a telescopic actuator.

According to another aspect, the telescopic actuator may be hydraulic.

According to another aspect, the wrench actuator may be connected to the first workpiece clamp by a first pivotal connection and to the wrench by a second pivotal connection.

According to another aspect, the first workpiece clamp may comprise a carriage that moves the first workpiece clamp along the chassis, and the wrench body may be mounted to the carriage.

According to another aspect, the wrench head may have an adjustable inner diameter.

According to another aspect, the wrench head may be self-adjusting.

According to another aspect, the wrench head may be reversible.

According to another aspect, the first clamp may have a minimum engagement diameter, and the wrench head may have a minimum engagement diameter that is less than the first minimum engagement diameter of the first clamp.

According to an aspect, there is provided a method of making and breaking internal connection on a downhole tool, the method comprising providing a makeup/breakout tool comprising a chassis, first and second workpiece clamps mounted to the chassis, wherein at least the first workpiece clamp is movable along a length of the chassis, each of the first and second workpiece clamps has a workpiece engagement area sized to receive a workpiece, the workpiece engagement areas being axially aligned, and at least one of the first and second workpiece clamps comprises a clamp actuator for applying torque to the workpiece, a wrench having a wrench head, the wrench being pivotally mounted to the first workpiece clamp, the wrench having a range of pivotal movement that allows the wrench head to move into and out of axial alignment with the workpiece engagement areas of the first and second workpiece clamps, and a wrench actuator that actuates the wrench head to apply torque to the workpiece, placing a the downhole tool into the workpiece engagement area of the first and second workpiece clamps, using the clamp actuator of at least one of the first and second workpiece clamps, manipulating a first threaded connection of the downhole tool having a diameter greater than a minimum engagement diameter, pivoting the wrench head into axial alignment with the workpiece engagement areas of the first and second clamps, and using the wrench actuator, manipulating a second threaded connection of the downhole tool having a diameter less than a minimum engagement diameter of the at least one of the first and second workpiece clamps.

According to another aspect, the wrench may be mounted to the first workpiece clamp by the wrench actuator, and the wrench actuator may comprise a telescopic actuator.

According to another aspect, the telescopic actuator may be hydraulic.

According to another aspect, the wrench actuator may be connected to the first workpiece clamp by a first pivotal connection and to the wrench by a second pivotal connection.

According to another aspect, the first workpiece clamp may comprise a carriage that moves the first workpiece clamp along the chassis, and the wrench body may be mounted to the carriage.

According to another aspect, the wrench head may have an adjustable inner diameter.

According to another aspect, the wrench head may be self-adjusting.

According to another aspect, the wrench head may be reversible.

According to another aspect, the first clamp may have a minimum engagement diameter, and the wrench head may have a minimum engagement diameter that is less than the first minimum engagement diameter of the first clamp.

In other aspects, the features described above may be combined together in any reasonable combination as will be recognized by those skilled in the art.

DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
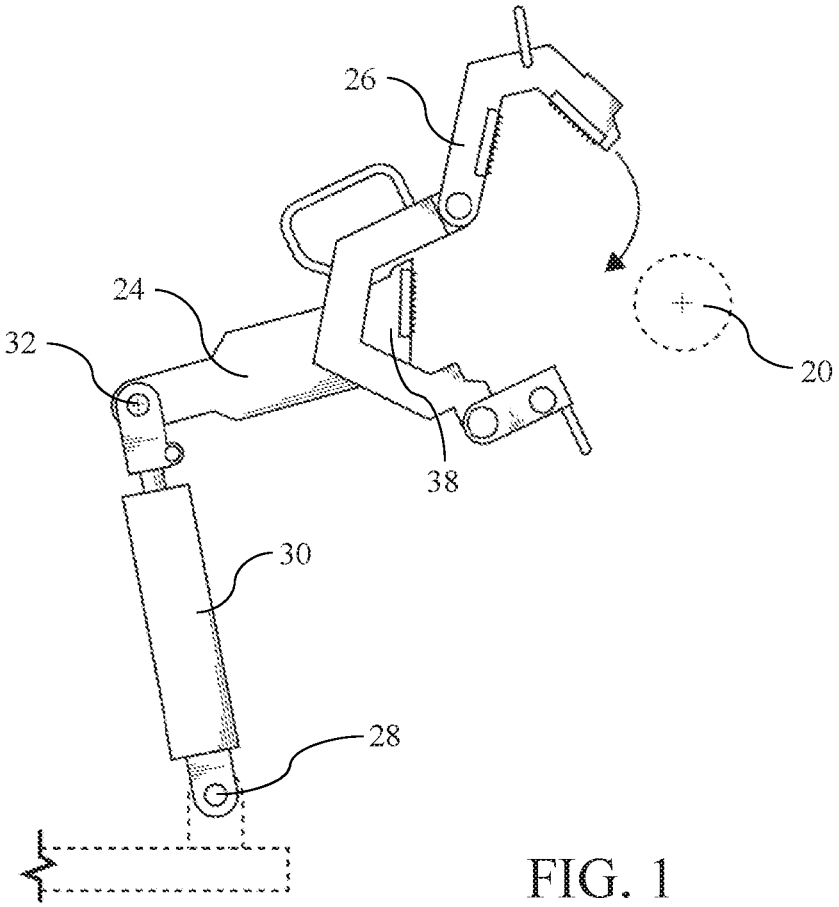
FIG. 1 is a front elevation view of a wrench for breaking internal connections reaching for and closing around a workpiece.

A makeup/breakout tool, generally identified by reference numeral 10, will now be described with reference to FIG. 1 through 15.

Figure 8:
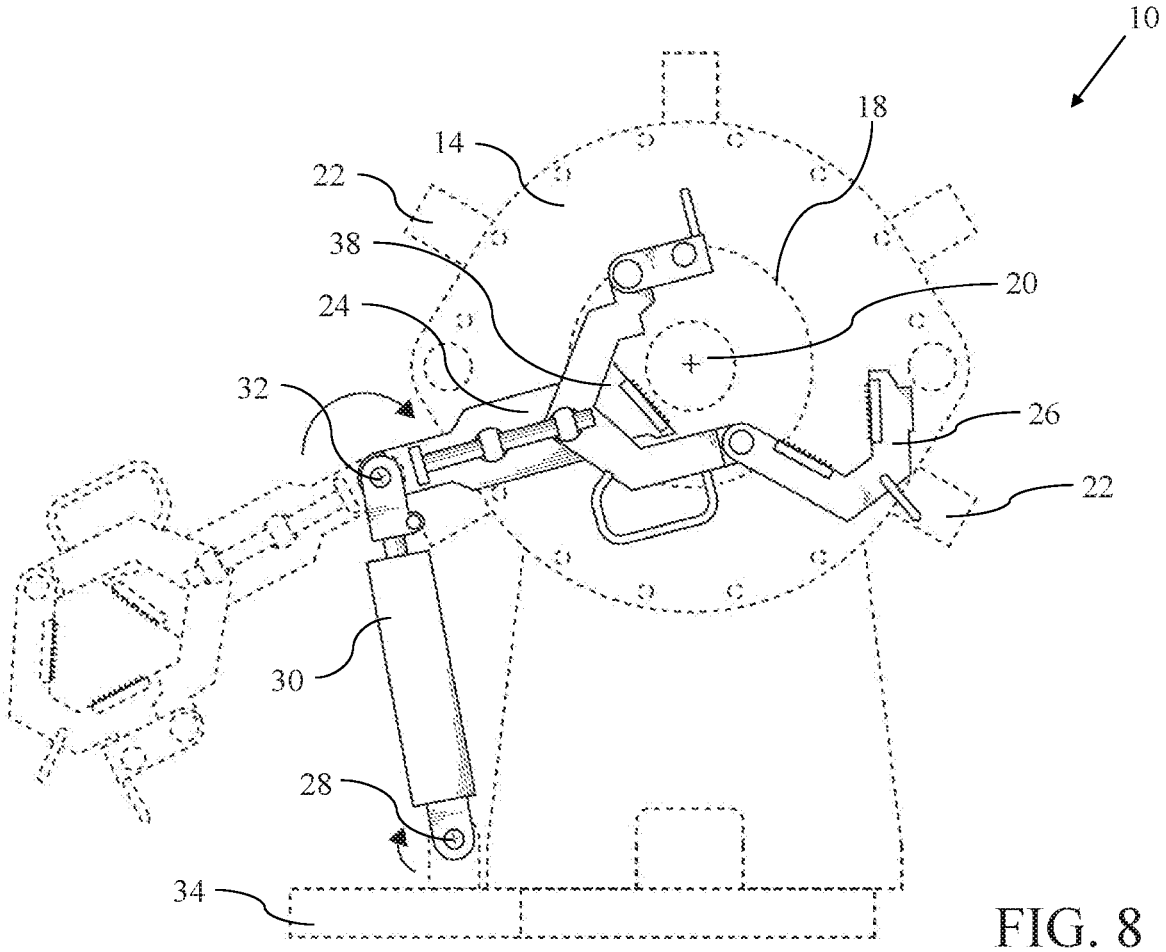
FIG. 8 is a front elevation view of the wrench for breaking internal connections of FIG. 1 in context with a makeup/breakout tool, where the wrench is folded toward the workpiece.
Figure 9:
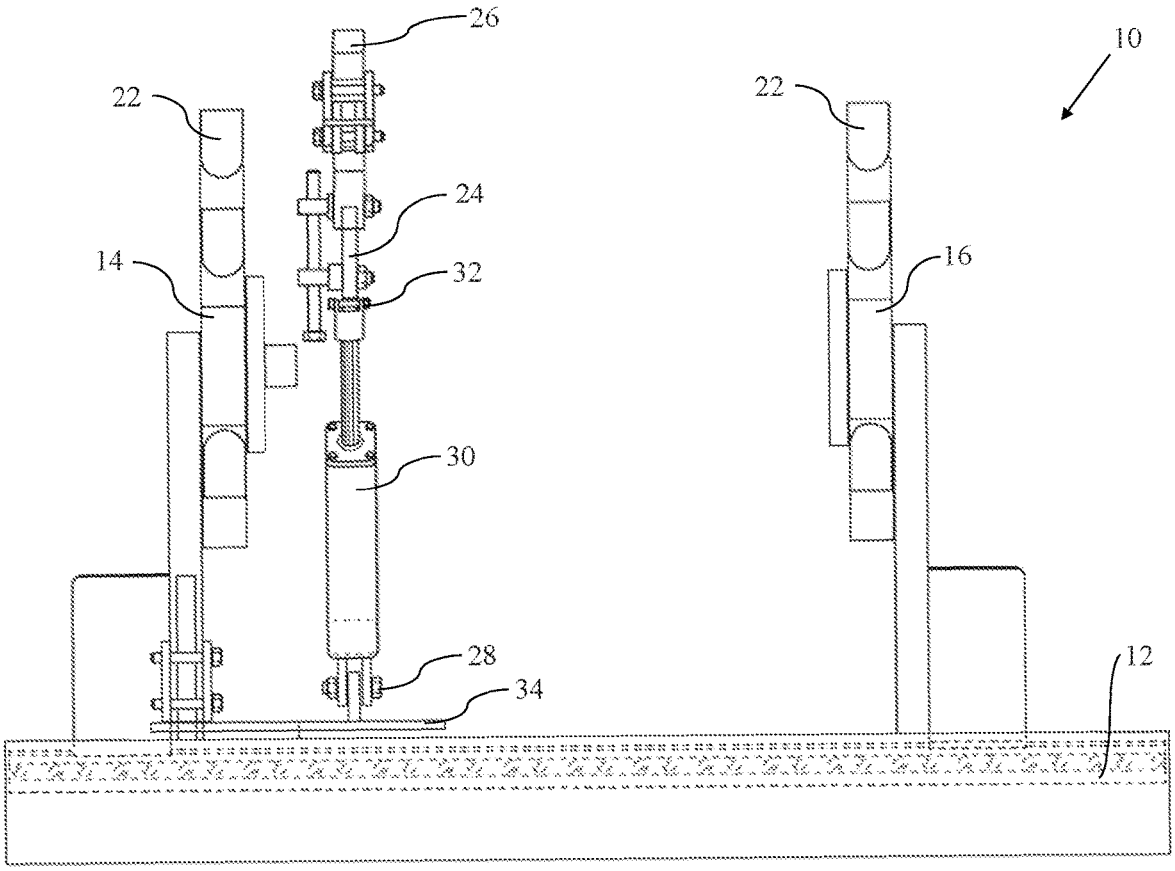
FIG. 9 is a side elevation view of a makeup/breakout tool having a wrench for breaking internal connections as shown in FIG. 1.

Referring to FIG. 9, a generic makeup/breakout tool 10 is shown with a chassis 12, and first and second workpiece clamps 14 and 16 mounted to chassis 12. As shown, workpiece clamp 14 is movable along the length of chassis 12, although both clamps 14 and 16 may be movable. Referring to FIG. 8, each of the workpiece clamps 14 and 16 has a workpiece engagement area 18. The workpiece engagement areas 18 are sized to receive a workpiece 20, and the workpiece engagement areas 18 of each of workpiece clamps 14 and 16 are axially aligned. At least one of workpiece clamps 14 and 16 has a clamp actuator 22 for applying torque to workpiece 20. As will be understood, the depicted makeup/breakout tool 10 is intended to refer to a generic design, and that the actual design of any particular makeup/breakout tool 10 that may be used will vary from what is depicted.

Figure 10:
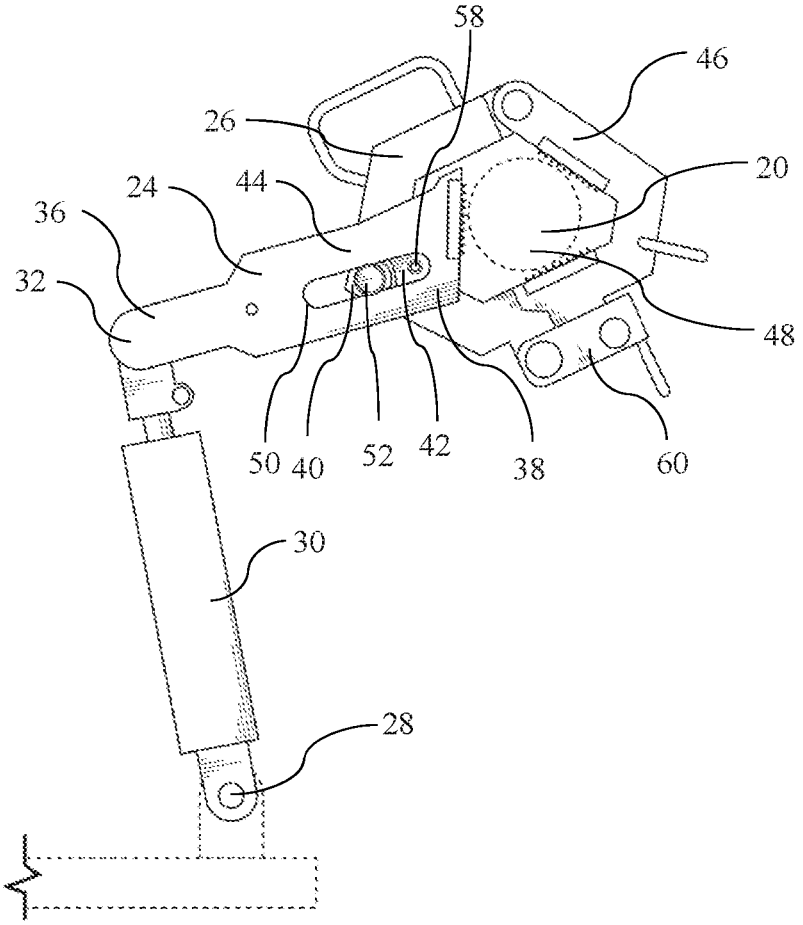
FIG. 10 is a front elevation view of the wrench for breaking internal connections having a pin and slot connection mechanism and a removable die.
Figure 11:
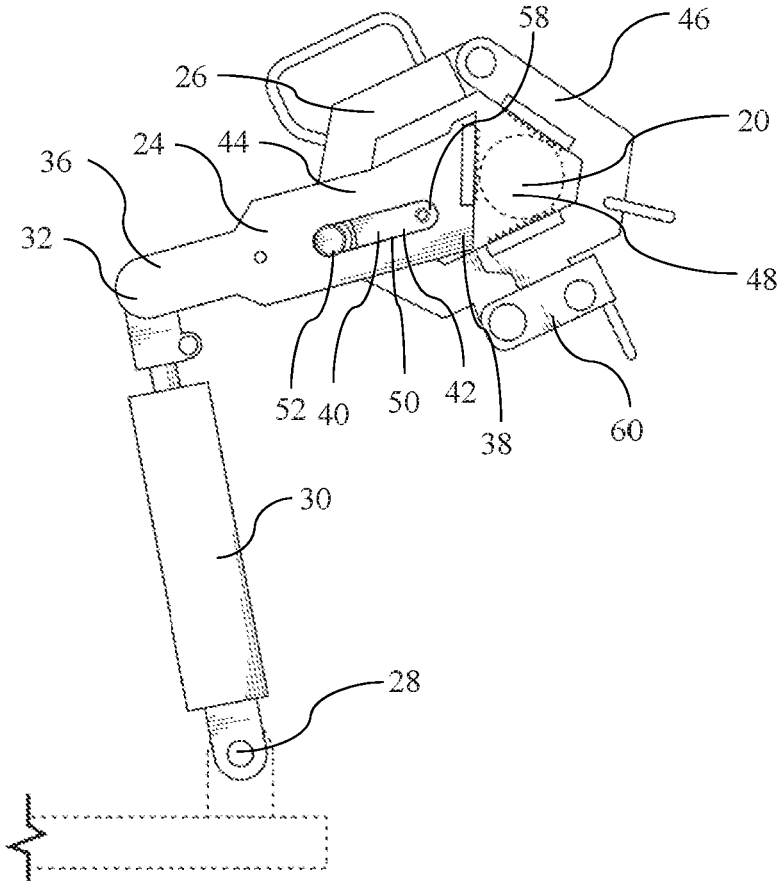
FIG. 11 is a front elevation view of the wrench for breaking internal connections of FIG. 10, with a removable die of a different size.

Referring to FIG. 8, makeup/breakout tool 10 has a wrench 24 with a wrench head 26. Wrench 24 is designed to be mounted to move with one of the clamps 14 or 16, such as workpiece clamp 14 in the depicted embodiment. Wrench head 26 may be of a standard size for a particular application, or may have an adjustable inner diameter for engaging different sizes of workpiece, such as by adjusting a length-adjustable member, adding or removing inserts, or replacing some or all of wrench head 26. Regardless of if wrench head 26 has a standard size, or has an adjustable inner diameter, the inner diameter of wrench head 26 will typically be selected such that wrench head 26 has an engagement diameter size that is less than the minimum engagement diameter of first workpiece clamp 14. This allows wrench head 26 to engage workpieces that are small than those that can be engaged by the first workpiece clamp 14. Where wrench head 26 has an adjustable inner diameter, wrench head 26 may be designed to be self-adjusting when closed around a workpiece 20. In the depicted example, wrench head 26 is adjustable by providing a sliding gripper 38 that is pushed toward the workpiece as actuator 30 applies a force to wrench head 26. This adjusts wrench head 26 to the necessary size, and also ensures a strong grip when applying torque. Referring to FIG. 10, wrench 24 may be sized using a slot and pin connection 40 to adjust sliding gripper 38. Slot and pin connection 40 may cooperate with a die 42, as shown in FIGS. 10 and 11 and discussed further below, sized to hold the jaws of wrench head 26 at a specific size. Wrench 24 may also be biased in order to apply an initial gripping force to workpiece 20. A spring (not shown) may be used to bias wrench 24. The spring may, for example, be a spring and pin installed into wrench head 26 that biases sliding gripper 38 into a gripping position. For an adjustable wrench head 26, the maximum engagement diameter size will preferably be around the minimum engagement diameter of first workpiece clamp 14 with only a small amount of overlap in order to reduce the design requirements on wrench 26. Wrench head 26 may also be reversible, allowing wrench head 26 to be turned in both directions.

Referring to FIG. 8, wrench 24 is actuated by wrench actuator 30 that causes wrench head 26 to apply torque to workpiece 20. Wrench actuator 30, may, for example, be a telescoping actuator, which may be a hydraulic actuator. Wrench actuator 30 may, for example, also be mechanically powered or use other actuation systems known in the art to be appropriate for the application. As shown, wrench 24 is mounted to first workpiece clamp 14 by wrench actuator 30. However, it will be understood that wrench 24 may be mounted to first workpiece clamp 14 using a variety of methods known in the art, and wrench actuator 30 may be in an alternate position, such as near wrench head 26. Wrench 24 may be equipped with a torque sensor that may be used to provide a digital readout or printout to allow for measurement of the torque applied to connections by wrench 24.

Figure 4:
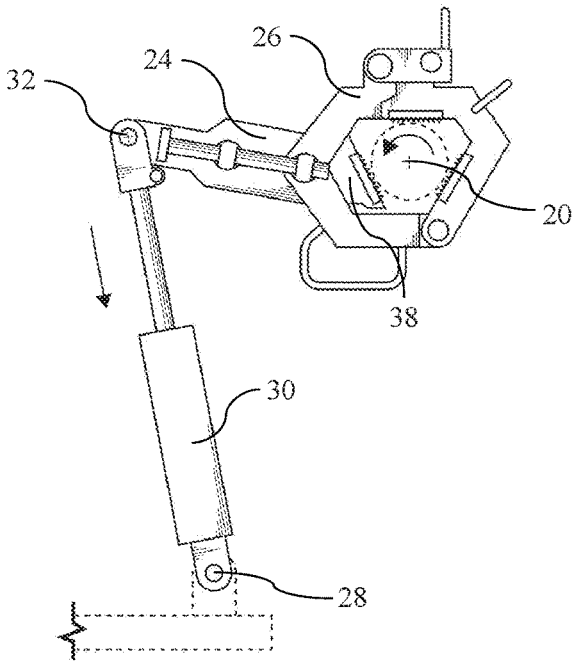
FIG. 4 is a front elevation view of the wrench for breaking internal connections of FIG. 1 closed around a workpiece and lowering to rotate the workpiece in a counter clockwise direction.
Figure 5:
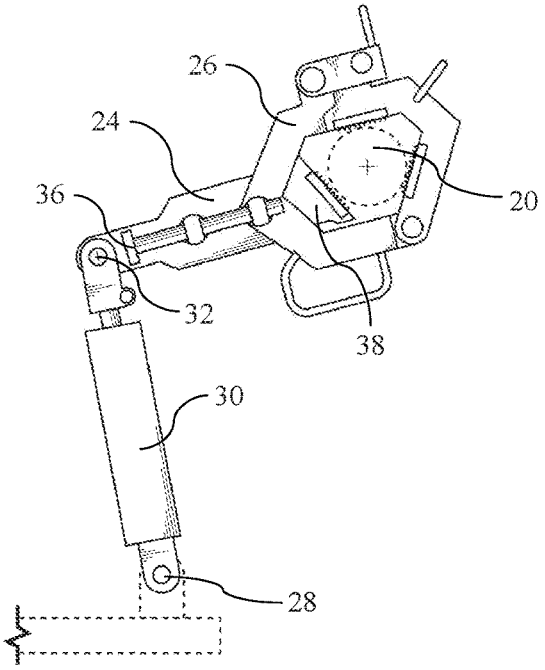
FIG. 5 is a front elevation view of the wrench for breaking internal connections of FIG. 1 closed around a workpiece that has been rotated in a counter clockwise direction.
Figure 6:
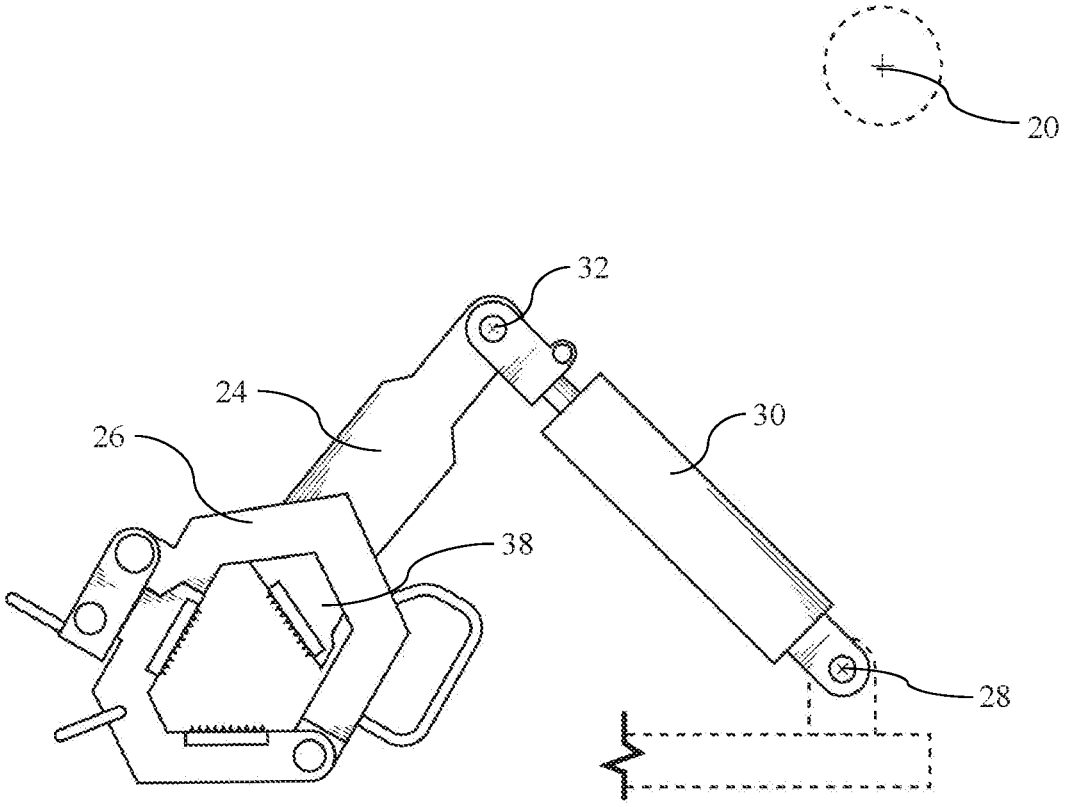
FIG. 6 is a front elevation view of the wrench for breaking internal connections of FIG. 1 that has been folded away from a workpiece.

In order to allow wrench 24 to properly engage workpiece 20, and to be moved out of the way when not in use, wrench 24 preferably has a number of positions that can be achieved, for example, by providing movable or adjustable connections. As shown, wrench 24 is pivotally mounted to the first workpiece clamp 14 by a pivotal mounting 28 connected to wrench actuator 30, which is in turn connected to wrench 24 by a second pivotal connection 32. As shown in FIGS. 4 and 5, pivotal connections 28 and 32 allow wrench 24 to engage and apply torque to workpiece 20. Referring to FIG. 6, pivotal connections 28 and 32 also allow wrench 24 to move out of the way by moving outward from the tool. In other designs, referring to FIG. 7, wrench 24 may also be designed to move in other directions as well. This may be by providing connection 32 as a universal joint, or permitting wrench head 24 to pivot about the hydraulic cylinder of wrench actuator 30 as shown.

Wrench 24 preferably has a range of pivotal movement that allows wrench head 26 to move into and out of axial alignment with workplace engagement areas 18 of first and second workpiece clamps 14 and 16. Referring to FIG. 9, first workpiece clamp 14 may have a carriage 34 that moves first workpiece clamp 14 along chassis 12. Wrench 24 may be mounted in a variety of locations depending on the application, such as on the side of first workpiece clamp 14, or mounted to carriage 34.

Figure 2:
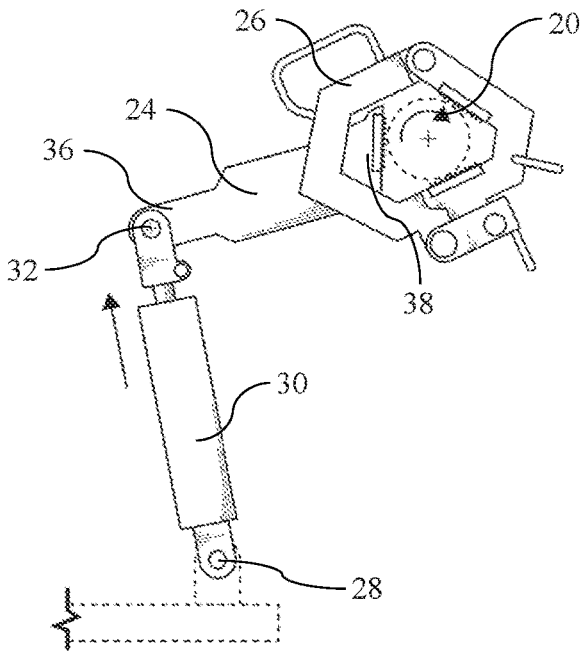
FIG. 2 is a front elevation view of the wrench for breaking internal connections of FIG. 1 closed around a workpiece and lifting to rotate the workpiece in a clockwise direction.
Figure 3:
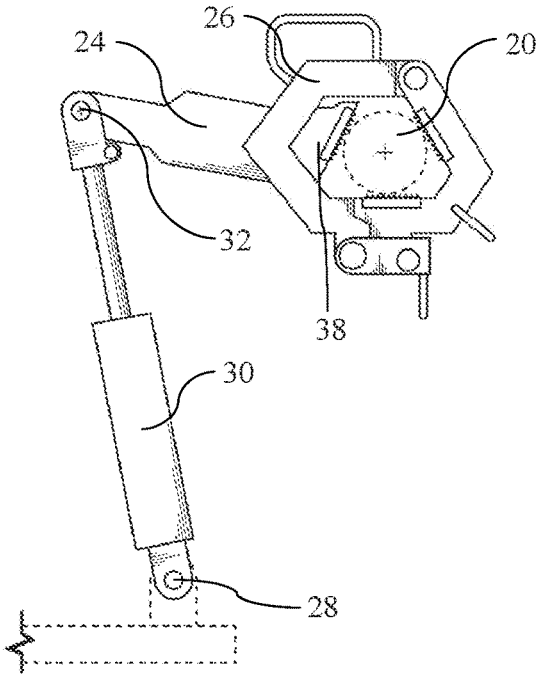
FIG. 3 is a front elevation view of the wrench for breaking internal connections of FIG. 1 closed around a workpiece that has been rotated in a clockwise direction.

Referring to FIG. 1, in order to engage a workpiece 20, wrench 24 is first aligned and then engaged with workpiece 20. As shown, wrench head 26 has a two-part hinged connection that allows workpiece 20 to be grasped by wrench head 26. However, it will be understood by those skilled in the art that wrench head 26 may take a variety of forms and connect to workpiece 20 in a variety of ways. In order to position wrench head 26, wrench 24 may be pivoted about pivotal mounting 28, as well as pivotal connection 32. These connections may allow for pivotal movement within a single plane, or may allow for pivotal movement in a variety of directions, depending on the application. Referring to FIG. 2 and FIG. 3, once wrench head 26 is secured around workpiece 20, wrench actuator 30 is activated to apply torque to workpiece 20, which will manipulate a threaded connection (not shown) of workpiece 20. As shown, wrench actuator 30 is a telescopic hydraulic actuator that raises the end 36 of wrench 24 that is opposite wrench head 26 to apply a clockwise rotation to workpiece 20. Wrench head 26 may have a gripping portion 38 as shown that tightens against workpiece 20 as wrench 24 is turned. Gripping portion 38 may serve to make wrench head 26 self-adjusting. Referring to FIG. 4 and FIG. 5, in order to turn workpiece 20 in the opposite direction, wrench head 26 may be reversed, such that gripping portion 38 tightens as wrench 24 is turned in the opposite direction. As shown, wrench actuator 30 lowers the end 36 of wrench 24 and workpiece 20 is turned in a counter-clockwise direction.

Figure 7:
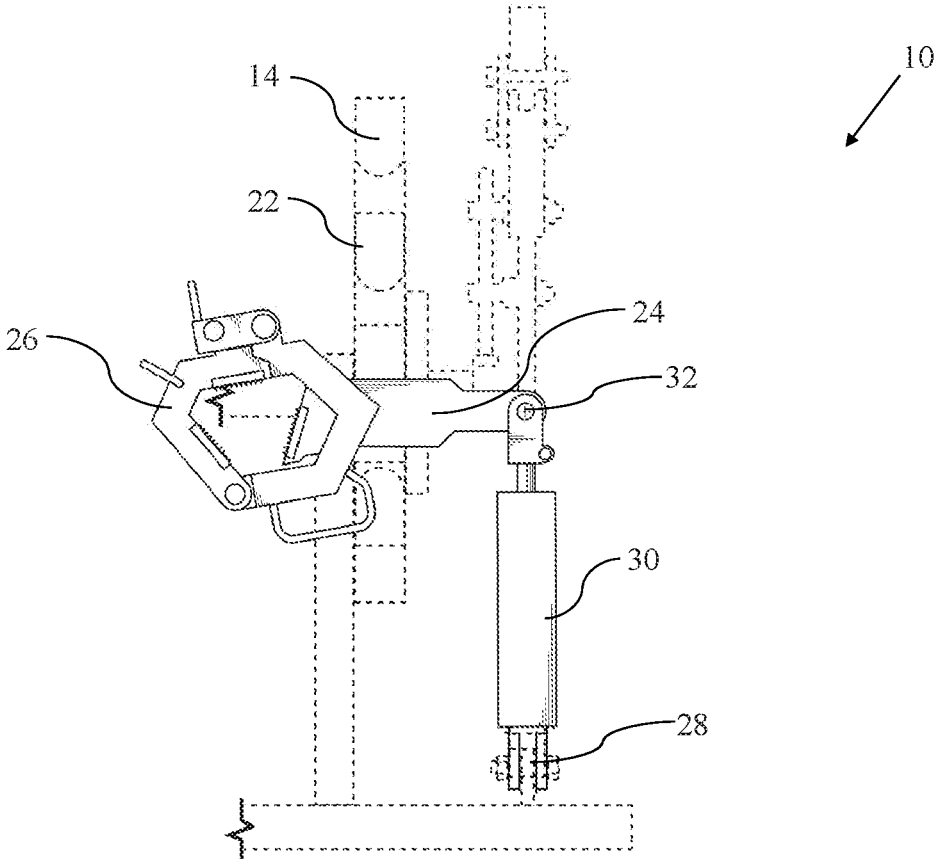
FIG. 7 is a side elevation view of the wrench for breaking internal connections of FIG. 1 in context with a makeup/breakout tool, where the wrench has been folded away from a workpiece.

Referring to FIG. 6, wrench 24 may be rotated out of alignment with the workpiece engagement areas 18 of the first and second workpiece clamps 14 and 16, allowing wrench 24 to be stored in a position that does not interfere with the work being done when wrench 24 is not needed. For example, workpiece clamps 14 and 16 may engage and manipulate threaded connections of workpiece 20 that have a diameter that is greater than the minimum engagement diameters of the workpiece clamps 14 and 16. Wrench 24 may only be needed when the workpiece to be manipulated has a diameter that is less than the minimum engagement diameter of the first and second workpiece clamps 14 and 16. This may allow for cooperation between the two tools to make and break threaded connections having a variety of sizes. Referring to FIG. 7, wrench 24 may be capable of rotation in a variety of directions for storage. Wrench 24 may be rotated through a plane that is parallel to the face of workpiece clamp 14 to move out of the way, as is shown in FIG. 8. Wrench 24 may also be rotated in a plane that is perpendicular, as shown in FIG. 7. It will be understood that wrench 24 may also be capable of movement in other directions. For example, wrench 24 may rotate to be stored alongside workpiece clamp 14.

Referring to FIG. 10 through FIG. 15, use of removable dies 42 to adjust the sizing of wrench 24 for different sizes of workpieces 20 will now be described. As discussed above, wrench 24 may be sized using a slot and pin connection 40 to adjust gripping portion 38. Referring to FIG. 10, wrench head 26 has a fixed jaw element 44 and an adjustable jaw element 46 opposite fixed jaw element 44. Fixed jaw element 44 and adjustable jaw element 46 define a workpiece engagement area 48 that receives and engages workpiece 20. Fixed jaw element 44 and adjustable jaw element 46 may be moved relative to one another in order to change the size of workpiece engagement area 48. For example, as shown in FIG. 10, when a larger workpiece 20 is to be engaged, adjustable jaw element 46 may be moved such that pin 52 moves away from end 36 of wrench 24 along slot 50. When a smaller workpiece 20 is to be engaged, as shown in FIG. 11, adjustable jaw element 46 may be moved such that pin 52 is moved closer to end 36 of wrench 24 along slot 50. As discussed above, fixed jaw element 44 may be a sliding gripper 38, while adjustable jaw element 46 can be opened in order to be placed around workpiece 20, and has a latching connection 60. The elements may also be reversed, with fixed jaw element 44 being fastened around workpiece 20, and adjustable jaw element 46 being moved into and out of engagement with workpiece 20. Fixed jaw element 44 and adjustable jaw element 46 may also take other forms, as will be understood by those skilled in the art. For example, fixed jaw element 44 and adjustable jaw element 46 may have three engagement surfaces as shown in FIG. 10, or they may be shaped to have two engagement surfaces, one on each jaw element.

Figure 12:
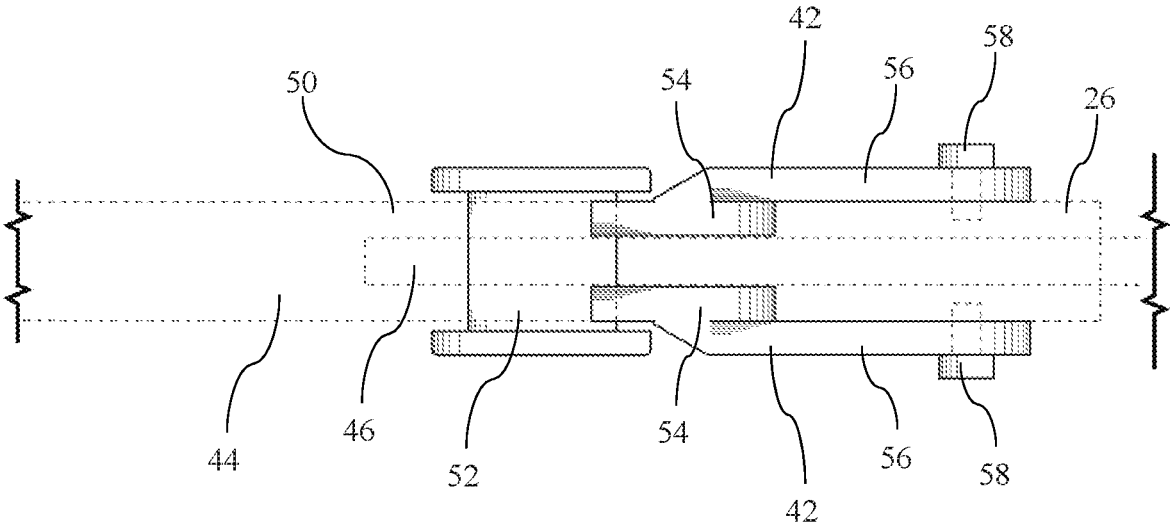
FIG. 12 is a top plan view of a pin and removable die.
Figure 13:
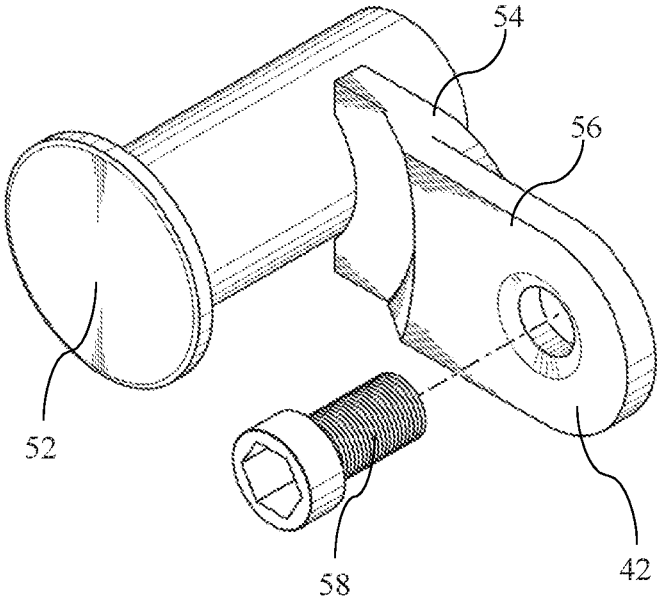
FIG. 13 is a perspective view of a pin and removable die.

Pin and slot connection 40 as shown is formed from slot 50 formed in fixed jaw element 44 and pin 52 attached to adjustable jaw element 46, connecting fixed jaw element 44 and adjustable jaw element 46 and permitting movement of adjustable jaw element 46 relative to fixed jaw element 44 in order to adjust the size of workpiece engagement area 48. Removable die 42 engages slot 50 to restrict the movement of pin 52 along slot 50 in order to define a maximum size of the workpiece engagement area 48 by controlling the position of pin 52, as discussed above. It will be understood that pin and slot connection 40 may also be formed with slot 50 being located in adjustable jaw element 46, and pin 52 being attached to fixed jaw element 44, with the location of die 42 being changed accordingly. It will be understood that die 42 might be on one end of slot 50 as shown, such that it only fixes the maximum size of workpiece engagement area 48, or two dies 42 may be used such that pin 52 is fixed in a particular location along slot 50. When die 42 is placed at only one end of slot 50, as shown, it will be possible for pin 52 to move toward end 36 of wrench 24. However, when workpiece 20 is placed in workpiece engagement area 48 the adjustable jaw element 46 will no longer be able to move freely to decrease the size of workpiece engagement area. It will also be understood that a single die 42 may be used in slot 50, as shown in FIG. 13, or two removable dies 42 that engage opposite sides of slot 50 to restrict the movement of pin 52 may be used, as shown in FIG. 12. As will be understood by a person skilled in the art, the choice of the number and placement of dies 42 will depend on a number of factors, such as the forces to be applied to workpiece 20, the material considerations, and the safety requirements. The selection of a single die 42 placed on one side of slot 50, two dies placed on either side of slot 50, two dies placed on either end of slot 50, or four dies placed in all the available positions can be made depending on these considerations.

Figure 14:
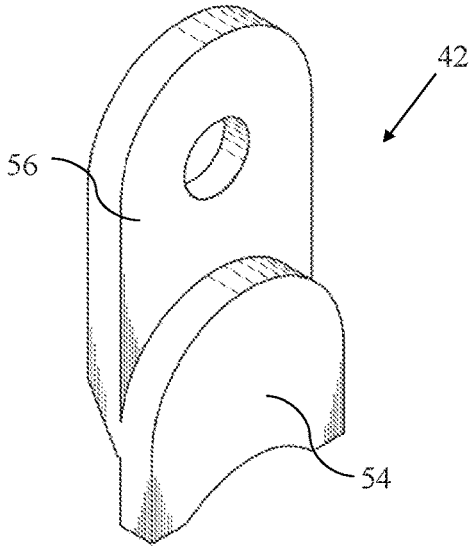
FIG. 14 is a first side perspective view of a removable die.
Figure 15:
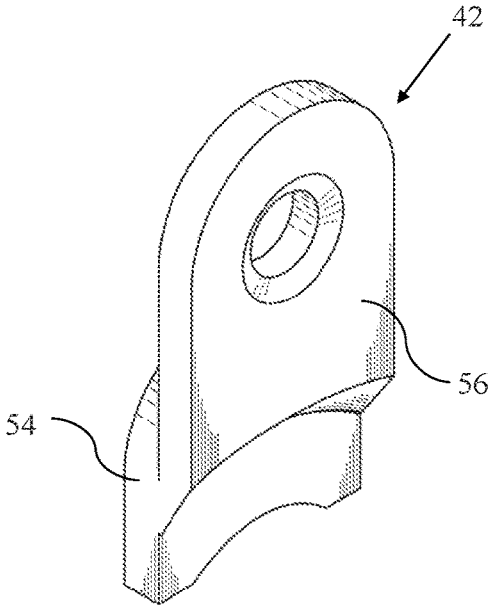
FIG. 15 is a second side perspective view of the removable die of FIG. 14.

Referring to FIG. 12, removable die 42 may have a slot engagement portion 54 that is received within slot 50 and an attachment portion 56 that engages an attachment point 58 on wrench head 26. Attachment portion 56 may be vertically offset from engagement portion 54, as shown in FIG. 14 and FIG. 15. It will be understood that engagement portion 54 and attachment portion 56 may also have different shapes, depending on the application. For example, the transition between engagement portion 54 and attachment portion 56 may be continuous. The top surface of removable die 42 may be flat, with engagement portion 54 and attachment portion 56 being flush on the top surface, and offset on the bottom surface. Referring to FIG. 10 and FIG. 11, wrench head 26 may be used with a plurality of removable dies 42 of different sizes corresponding to different workpiece engagement areas 48, each of the plurality of removable dies 42 being interchangeable with another of the plurality of removable dies 42. This allows wrench head 26 to be sized for a plurality of different diameters of workpiece 20. For example, wrench 24 may have a set of removable dies 42 corresponding to standard pipe sizes.

As discussed above, wrench 24 has an actuator 30, which is an articulated actuator 30 that actuates wrench head 26 to apply torque to workpiece 20. Articulated actuator 30 may be a linear actuator, such as a telescopic actuator, and may have a second pivotal connection 32 between wrench 24 and an elongate body and a first pivotal connection 28 between the elongate body and a base. It will be understood that other means of actuating wrench head 26 as known in the art and discussed above may be used. Wrench head 26 may be reversible, as discussed above, allowing for torque to be applied to workpiece 20 in either a clockwise or a counter-clockwise direction.

A method of using wrench 24 on workpiece 20 will now be described. Wrench head 26 is provided, and a maximum size of workpiece engagement area 48 is defined by engaging slot 50 with removable die 42 to restrict the movement of pin 52 along slot 50. The maximum size is selected to accommodate the diameter of a given workpiece 20. Workpiece 20 is positioned within workpiece engagement area 48 by moving adjustable jaw element 46 relative to fixed jaw element 44. With workpiece 20 within workpiece engagement area 48, articulated actuator 30 is actuated to cause wrench head 26 to apply torque to workpiece 20. It will be understood that die 42 may be inserted to define the maximum size of workpiece engagement area 48 either prior to or after positioning workpiece 20 and moving adjustable jaw element 46. Removable die 42 may be engaged with the slot by inserting slot engagement portion 54 within slot 50, and engaged with attachment point 58 on wrench head 26 using attachment portion 56 of removable die 42. The same procedure may be used to engage slot 50 with two removable dies 42 that engage opposite sides of slot 50, as shown in FIG. 12, to restrict the movement of pin 52 along slot 50. In order to use wrench 24 with different sizes of workpiece 20, the maximum size of workpiece 20 may be changed by interchanging removable die 42 with another removable die 42 selected from a plurality of removable dies 42 of different sizes corresponding to different workpiece engagement areas 48. In order to apply torque in the opposite direction, such as if it is desired to both form and release threaded connections, wrench head 26 may be reversed relative to workpiece 20 to apply torque in both opposite directions.

Technical effects of the disclosure include an adjustable wrench with jaws that may be maintained at various sizes to accommodate different size workpieces. The use of removable dies, as described above, enable the fixed jaw element and adjustable jaw element of the wrench to be maintained in a desired relationship in order to define a desired workpiece engagement area for the adjustable wrench. The removability and the interchangeability of the dies may facilitate adjustment of the wrench to standard pipe sizes.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A wrench for a workpiece, comprising:

a wrench head, comprising:

a fixed jaw element and an adjustable jaw element opposite the fixed jaw element, the fixed jaw element and the adjustable jaw element defining a workpiece engagement area that receives and engages the workpiece; and a pin and slot connection connecting the fixed jaw element and the adjustable jaw element that permits movement of the adjustable jaw element relative to the fixed jaw element to adjust the size of the workpiece engagement area, wherein the pin and slot connection comprises a pin and a slot of the fixed jaw element, and wherein the pin is in physical contact with the fixed jaw element and the adjustable jaw element;

a latching connection configured to latch the fixed jaw element to the adjustable jaw element;

a removable die removeable from the slot, wherein the removable die engages the slot to restrict the movement of the pin along the slot and define a maximum size of the workpiece engagement area, wherein:

the removable die is an integral piece that does not include a portion of the removable die that is movable with respect to another portion of the removable die, the removable die comprises a slot engagement portion that is received within the slot, the slot engagement portion comprises an open arcuate recess that is in physical contact with the pin, and the removable die comprises an attachment portion that is offset from the slot engagement portion in a first direction, wherein the removable die is in physical contact with the wrench head, and engages an attachment point on the wrench head; and an articulated actuator that actuates the wrench head to apply torque and gripping force to the workpiece, comprising:

an elongate body;

a first pivotal connection between the wrench head and the elongate body, wherein:

the articulated actuator actuates the wrench head around the first pivotal connection to apply torque to the workpiece on a first plane of rotation, and the first direction is perpendicular to the first plane of rotation; and a second pivotal connection between the elongate body and a base, wherein the articulated actuator is rotatable around the second pivotal connection on a plane perpendicular to the first plane of rotation.

2. The wrench of claim 1, wherein the articulated actuator comprises a telescopic actuator.

3. The wrench of claim 1, wherein the wrench head is reversible whereby the articulated actuator actuates the wrench head to move in a first plane.

4. The wrench of claim 1, wherein the removable die is one of a plurality of removable dies of different sizes corresponding to different workpiece engagement areas, each of the plurality of removable dies being interchangeable with another of the plurality of removable dies.

5. The wrench of claim 1, comprising a second removable die, wherein the first removable die and the second removable die engage opposite sides of the slot to restrict the movement of the pin.

6. A method of using a wrench on a workpiece having a diameter, the method comprising the steps of:

providing a wrench head mounted to an articulated actuator, wherein:

the wrench head comprises a fixed jaw element and an adjustable jaw element opposite the fixed jaw element, the fixed jaw element and the adjustable jaw element are connected by a pin and slot connection that permits movement of the adjustable jaw element relative to the fixed jaw element, the fixed jaw element and the adjustable jaw element define a workpiece engagement area, latching the fixed jaw element to the adjustable jaw element with a latching connection between the fixed jaw element and the adjustable jaw element;

the pin and slot connection comprises a pin and a slot of the fixed jaw element, and wherein the pin is in physical contact with the fixed jaw element and the adjustable jaw element, and the articulated actuator comprises:

an elongate body;

a first pivotal connection between the wrench head and the elongate body;

a second pivotal connection between the elongate body and a base, wherein the articulated actuator is rotatable around the second pivotal connection on a plane perpendicular to the a first plane of rotation;

defining a maximum size of the workpiece engagement area by inserting a removable die into the slot to restrict the movement of the pin along the slot, the maximum size being selected to accommodate the diameter of the workpiece, wherein:

the removable die is removable from the slot, the removable die is an integral piece that does not include a portion of the removable die that is movable with respect to another portion of the removable die, the inserting of the removable die comprises inserting a slot engagement portion of the removable die within the slot and engaging a first attachment point on the wrench head with a second attachment portion of the removable die, the slot engagement portion comprises an open arcuate recess that is in physical contact with the pin, and the attachment portion is offset from the slot engagement portion in a first direction;

positioning the workpiece within the workpiece engagement area by moving the adjustable jaw element relative to the fixed jaw element;

with the workpiece within the workpiece engagement area, actuating the articulated actuator to actuate the wrench head around the first pivotal connection to apply torque to the workpiece on a first plane of rotation that is perpendicular to the first direction and to apply gripping force to the workpiece; and actuating the articulated actuator to actuate the wrench head around the second pivotal connection.

7. The method of claim 6, wherein the articulated actuator comprises a telescopic actuator.

8. The method of claim 6, further comprising the step of reversing the wrench head relative to the workpiece to apply torque in an opposite direction.

9. The method of claim 6, wherein the removable die is a first removable die, and wherein engaging the slot with the first removable die comprises engaging the slot with a pair of removable dies comprising the first removable die and a second removable die, wherein the pair of removable dies that-engage opposite sides of the slot to restrict the movement of the pin along the slot.

10. The method of claim 6, wherein the removable die is a first removable die of a plurality of removable dies of different sizes corresponding to different workpiece engagement areas, and wherein the method further comprises:

removing the first removable die from the slot;

positioning a workpiece into the workpiece engagement area;

moving the adjustable jaw element to change the maximum size of the workpiece engagement area; and inserting a second removable die of the plurality of removable dies into the slot.

11. A wrench set for a workpiece, comprising:

a wrench head, comprising:

a fixed jaw element and an adjustable jaw element opposite the fixed jaw element, the fixed jaw element and the adjustable jaw element defining a workpiece engagement area that received and engages the workpiece;

a pin and slot connection connecting the fixed jaw element and the adjustable jaw element that permits movement of the adjustable jaw element relative to the fixed jaw element to adjust the size of the workpiece engagement area, wherein the pin and slot connection comprises a pin and a slot of the fixed jaw element, and wherein the pin is in physical contact with the fixed jaw element and the adjustable jaw element;

a latching connection configured to latch the fixed jaw element to the adjustable jaw element;

a plurality of removable dies of different sizes corresponding to different workpiece engagement areas, wherein:

each removable die of the plurality of removable dies is interchangeable with another die of the plurality of removable dies, each removable die of the plurality of removable dies is configured to engage the slot to restrict the movement of the pin along the slot and define a respective maximum size of the workpiece engagement area and to be removable from the slot, each respective removable die is an integral piece that does not include a portion of the respective removable die that is movable with respect to another portion of the respective removable die, each removable die of the plurality of removable dies comprises a slot engagement portion that is received within the slot and an attachment portion that engages an attachment point on the wrench head to apply torque and gripping force to the workpiece, each removable die of the plurality of removable dies comprises an open arcuate recess that is in physical contact with the pin, and each removable die comprises an attachment portion that is offset from the slot engagement portion in a first direction, each removable die is configured to mate in physical contact with the wrench head, and engages an attachment point on the wrench head; and an articulated actuator that actuates the wrench head, wherein the articulated actuator comprises a telescopic actuator, comprising:

an elongate body;

a first pivotal connection between the wrench head and the elongate body, wherein:

the articulated actuator actuates the wrench head around the first pivotal connection to apply torque to the workpiece on a first plane of rotation, and the first direction is perpendicular to the first plane of rotation; and a second pivotal connection between the elongate body and a base, wherein the articulated actuator is rotatable around the second pivotal connection on a plane perpendicular to the first plane of rotation.

* * * * *